US006293385B1

(12) United States Patent
Hayashi et al.

(10) Patent No.: US 6,293,385 B1
(45) Date of Patent: Sep. 25, 2001

(54) COIN SORTING DEVICE USING DATA RELATED TO FALSE COINS THEMSELVES

(75) Inventors: Makoto Hayashi, Isesaki; Hironori Ito, Maebashi, both of (JP)

(73) Assignee: Sanden Corp. (JP)

( * ) Notice: Subject to any disclaimer, the term of this patent is extended or adjusted under 35 U.S.C. 154(b) by 0 days.

(21) Appl. No.: 09/447,791

(22) Filed: Nov. 23, 1999

(30) Foreign Application Priority Data

Nov. 25, 1998 (JP) ..... 10-334020

(51) Int. Cl.[7] ..... G07D 5/08
(52) U.S. Cl. ..... 194/317
(58) Field of Search ..... 194/317, 318, 194/319

(56) References Cited

U.S. PATENT DOCUMENTS

| | | | | |
|---|---|---|---|---|
| 3,682,286 | * | 8/1972 | Prumm | 194/317 |
| 4,108,296 | * | 8/1978 | Hayashi et al. | 194/318 |
| 5,085,309 | * | 2/1992 | Adamson et al. | 194/317 |
| 5,730,272 | | 3/1998 | Dobbins et al. . | |
| 5,931,277 | * | 8/1999 | Allan et al. | 194/317 |
| 6,082,518 | * | 7/2000 | Itako et al. | 194/317 |

FOREIGN PATENT DOCUMENTS

| | | | | |
|---|---|---|---|---|
| 4204056C | | 7/1993 | (DE) . | |
| 480736 A | * | 4/1992 | (EP) | 194/317 |
| 2-217987 A | * | 8/1990 | (JP) | 194/317 |
| 9636022A | | 11/1996 | (WO) . | |

OTHER PUBLICATIONS

European Search Report for EPO Application No. EP99309372.

* cited by examiner

*Primary Examiner*—Eileen D. Lillis
*Assistant Examiner*—Thuy V. Tran
(74) *Attorney, Agent, or Firm*—Banner & Witcoff, Ltd.

(57) ABSTRACT

In a coin sorting device having a fundamental function for judging whether or not a deposited coin is included in a true-coin kind, an additional function is provided to judge about whether or not the deposited coin is included in a false-coln kind. The true-coln kind is represented by a first coin datum memorized in a first memory part (27). The false-coin kind is represented by a second coin datum memorized in a second memory part (28). The additional function is achieved in response to the second coin datum and a third coin datum representative of a coin which is deposited as the deposited coin into the coin sorting device. The fundamental function is achieved in response to the first and the third coin data.

9 Claims, 7 Drawing Sheets

| INPUT OF FALSE COIN | COIN SENSOR 13a | COIN SENSOR 13b | COIN SENSOR 13c |
|---|---|---|---|
| 1ST TIME | 228 | 101 | 148 |
| 2ND TIME | 226 | 103 | 147 |
| 3RD TIME | 227 | 102 | 146 |
| MINIMUM VALUE | 226 | 101 | 146 |
| MAXIMUM VALUE | 228 | 103 | 148 |

FIG. 5A

| NUMBER OF INPUT COIN | CORRECTION VALUES | COIN SENSOR 13a | COIN SENSOR 13b | COIN SENSOR 13c |
|---|---|---|---|---|
| 1 – 9 | FOR UPPER LIMIT | +3 | +2 | +3 |
| | FOR LOWER LIMIT | −4 | −2 | −3 |
| 10 – 19 | FOR UPPER LIMIT | +2 | +1 | +2 |
| | FOR LOWER LIMIT | −3 | −1 | −2 |
| 20 – 29 | FOR UPPER LIMIT | +1 | 0 | +1 |
| | FOR LOWER LIMIT | −2 | 0 | −1 |
| 30 or more | FOR UPPER LIMIT | 0 | 0 | 0 |
| | FOR LOWER LIMIT | 0 | 0 | 0 |

FIG. 5B

COIN SORTING DEVICE USING DATA RELATED TO FALSE COINS THEMSELVES

BACKGROUND OF THE INVENTION

The present invention relates to a coin sorting device which is suitable for vending machines.

For this type of conventional coin sorting device, an electronic coin sorting system has been generally adopted. The electronic coin sorting system is equipped with a coin sensor in a coin passage through which deposited coins pass. The coin sensor consists of an exciting coil to which a signal of given frequency is input from an oscillation circuit, and a reception coil arranged as electromagnetically coupled with the exciting coil. When there is no coin in the coin passage, the coin sensor generates a constant induced electromotive force of given frequency. The presence of a coin in the coin passage results in eddy currents developing in the coin and the induced electromotive force obtained by the reception coil shows a characteristic change unique to the coin. A voltage change, for example, is used as a parameter for extracting the characteristic change, thus determining the denomination and genuineness of the coin.

The following is a detailed explanation about this determination. In case where data obtained by the reception coil are voltage data upon which the determination is made, the maixmum and minimum values of voltage are preset such that the coin is determined as a true coin when the maximum and minimum voltage values are within the preset range, and as a forged or false coin when it is beyond the range. It should be noted that a plurality of coin sensors are provided for different characteristics of a coin, such as diameter, material, and thickness, assigning each sensor a frequency adaptable to each sensor's screening.

The truth/falsity determination of a coin is thus made, but forged or false coins may be frequently deposited to a vending machine depending on the site the vending machine is located. In expectation of such a case, the coin sorting device is provided with a changeover switch for changing over degrees of sorting precision so that the sorting can be improved.

However, since the conventional coin sorting device is to improve the sorting precision by changing the preset maximum and minimum values, a change in range do not always bring proper values for all the false coins. Therefore, even if the sorting precision is improved, a problem remains in that some false coins falling in the same data range as that for true coins cannot be eliminated.

Furthermore, the change in range generally stiffens the requirements for all the ranges of identifying characteristics such as diameter, material, and thickness across the board, and this reduces the rate of acceptance of true coins.

SUMMARY OF THE INVENTION

It is therefore an object of the present invention to provide a coin sorting device of the type described, in which only the false coins can be eliminated without fail.

It is another object of the present invention to provide a coin sorting device in which the sorting precision is improved by the use of data related to false coins themselves.

It is still another object of the present invention to provide a coin sorting device of the type described, which has a mode for rejecting false coins by the use of a coin datum representative of a false-coin kind, separately from a conventional coin sorting mode.

Other objects of the present will become clear as the description proceeds.

According to the present invention, there is provided a coin sorting device comprising first memorizing means for memorizing a first coin datum representative of a true-coin kind, second memorizing means for memorizing a second coin datum representative of a false-coin kind, data generating means for generating a third coin datum representative of a coin which is deposited as a deposited coin into the coin sorting device, first judging means connected to the first memorizing and the data generating means and responsive to the first and the third coin data for judging whether or not the deposited coin is included in the true-coin kind, and second judging means connected to the second memorizing and the data generating means and responsive to the second and the third coin data for judging whether or not the deposited coin is included in the false-coin kind.

BRIEF DESCRIPTION OF THE DRAWING

FIG. 5A is a table showing false-coin data taken in response to input of the false coin;

FIG. 5B is a table showing relation between the number of input coin and correction values;

DESCRIPTION OF THE PREFERRED EMBODIMENT

Figure 1:
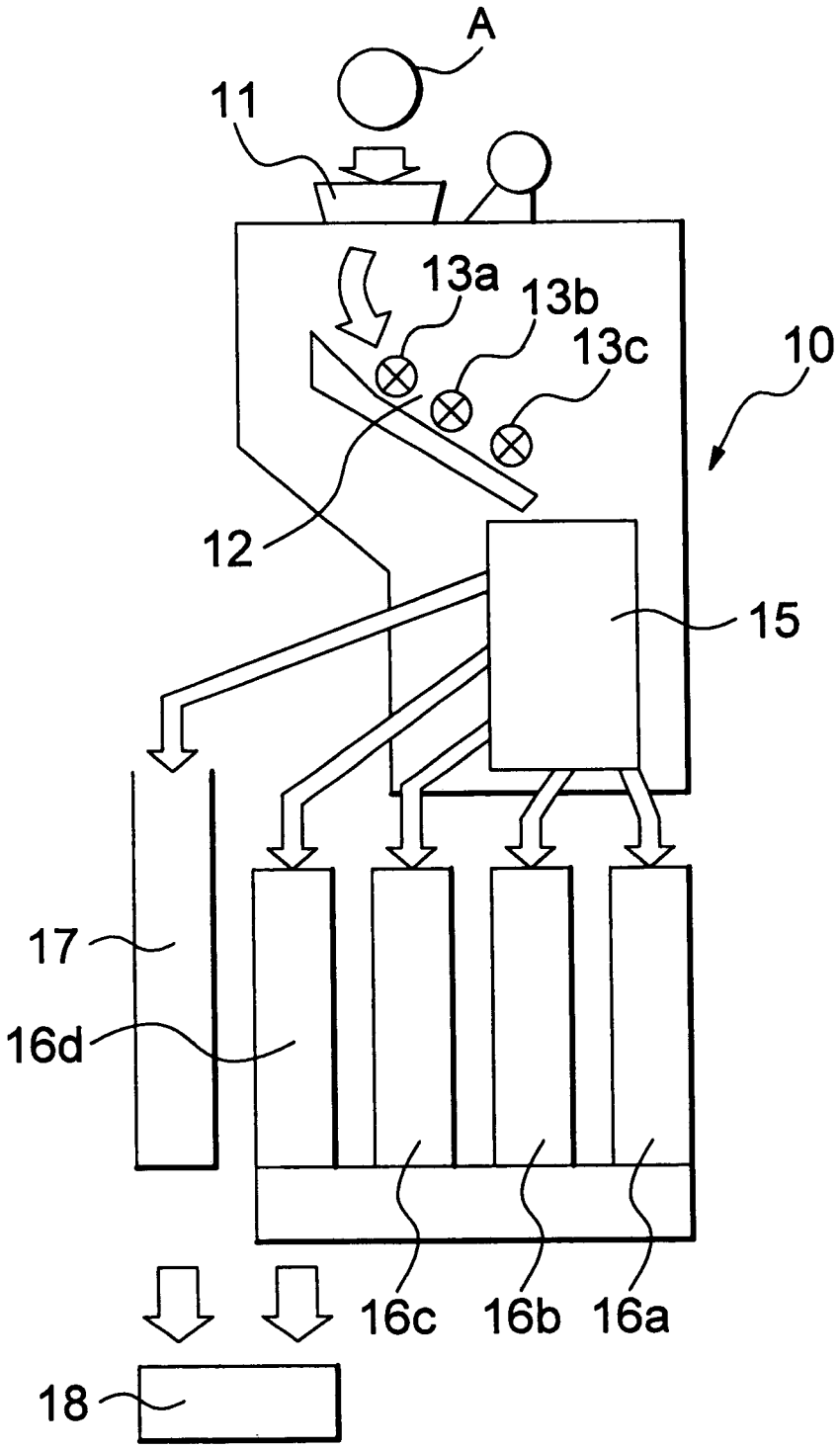
FIG. 1 is a schematic diagram illustrating the structure of a coin sorting device according to an embodiment of the present invention.

With reference to FIG. 1 at first, description will be made as regards structure of a coin sorting device 10 according to an embodiment of the present invention. In FIG. 1, open arrows indicate a flow of coin A.

The coin sorting device 10 allows coin A to be deposited or input from a coin slot 11 and pass through a coin passage 12. The coin is sensed by coin sensors 13*a,* 13*b* and 13*c* arranged along the coin passage 12. A microcomputer 14, as will be described later, determines the denomination and genuineness of input coins based on detected signals. Then, a coin distributor 15 distributes true coins to respective coin tubes 16*a,* 16*b,* 16*c* and 16*d* according to the kind, and false coins to a return slot 18 through an exhaust passage 17.

Figure 2:
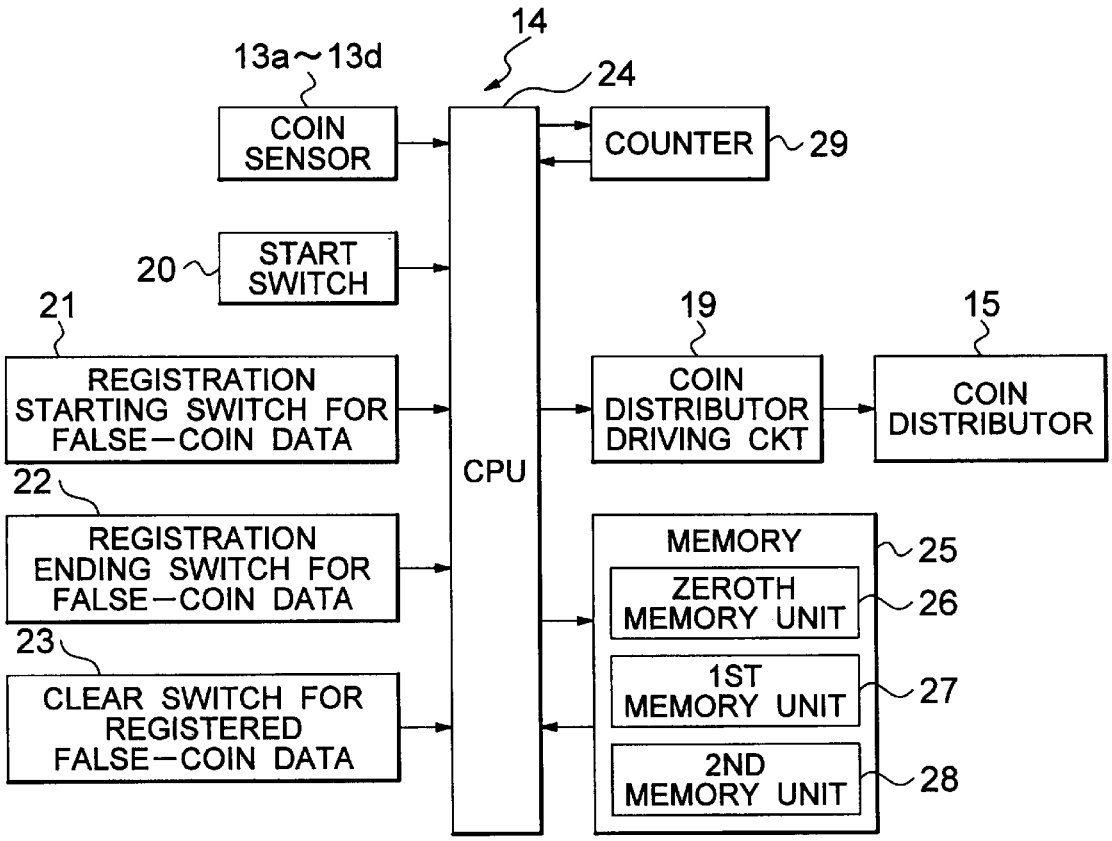
FIG. 2 is a block diagram illustrating a driving circuit of the coin sorting device of FIG. 1.

With reference to FIG. 2, the description will be made as regards a drive control circuit of the coin sorting device 10. Similar parts are designated by like reference numerals.

The microcomputer 14 includes a central processing unit (CPU) 24, a memory 25, and a counter 29. The CPU 24 controls the coin distributor 15 through a coin distributor driving circuit 19 in the manner known in the art. The CPU 24 also serves to store the maximum and minimum values of voltage detected by the coin sensors 13*a* to 13*c* and other data in a zeroth memorizing part 26 of the memory 25 in response to input of signals from the coin sensors 13*a* to 13*c*, a startup switch 20, a registration starting switch (hereinafter, called the start switch) 21 for false-coin data, a registration ending switch (hereinafter, called the end switch) 22 for false-coin data, and a clear switch (hereinafter, called the clear switch) 23 for registered false-coin data. The memory 25 further includes a first memorizing part 27 for memorizing first coin data representative of true coin kinds and a second memorizing part 28 for memorizing second coin data representative of false coin kinds. The counter 29 is for counting the number of deposition or input of a predetermined false coin to produce a counted signal representative of the number of the deposition.

In the manner which will presently be described, the drive control circuit thus configured carries out registration control for false-coin data, coin sorting control, and batched clear control for false-coin data.

Figure 3:
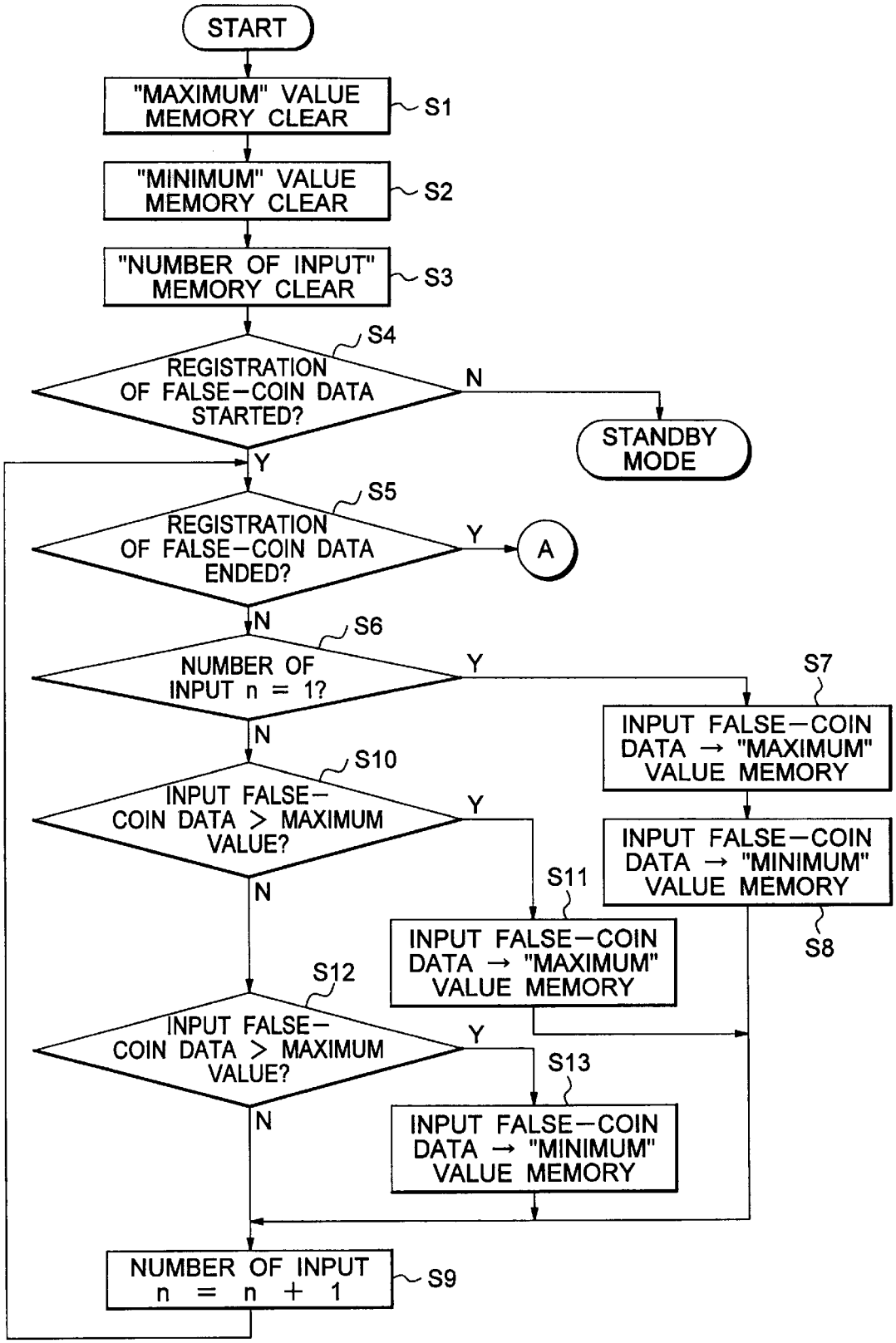
FIG. 3 is a flowchart for describing a part of registration control for false-coin data in the coin sorting device of FIGS. 1 and 2.
Figure 4:
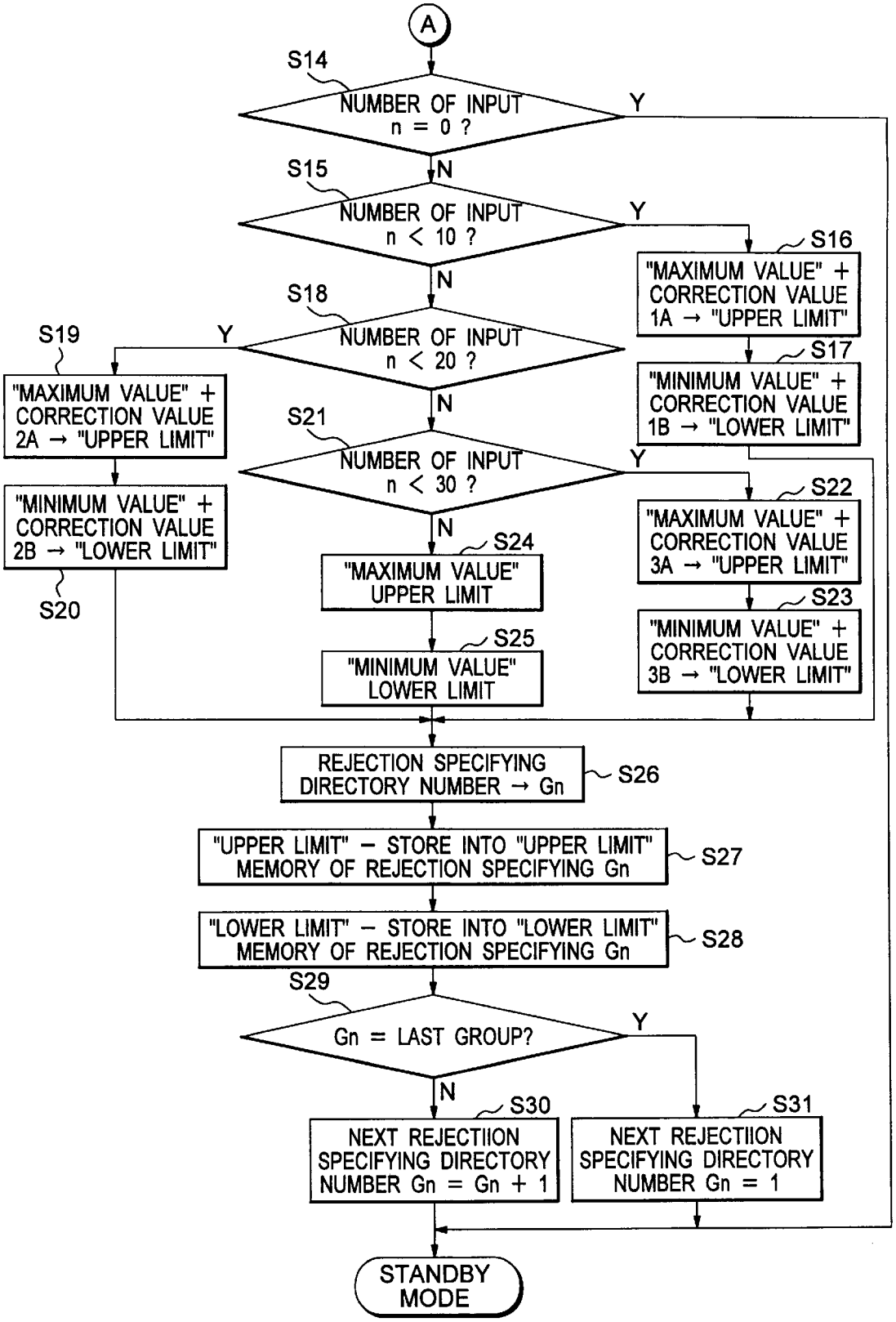
FIG. 4 is a flowchart for describing the remaining part of registration control for the false-coin data in the coin sorting device of FIGS. 1 and 2.

With reference to FIGS. 3 and 4 in addition, the description will be made as regards the registration control for the false-coin data. The registration control for the false-coln data is to register characteristics of a false coin that is frequently deposited, whereby the same kind of false coins are eliminated when deposited.

Upon turning on the startup switch 20, if the maximum and minimum voltage values for various kinds of false-coin data, and the number of times the false-coin data are input (hereinafter, referred to as the number of inputs) have been already stored, all the data are erased (S1–S3). Then, the predetermined false coin is deposited or input from the coin slot 11 on the condition that the start switch 21 is turned on but the end switch 22 is not on (S4 and S5). If the kind of coin is deposited for the first time (the number of inputs=1), data on the deposited false coin are stored in the zeroth memorizing part 26 of the memory 25 as the maximum and minimum values (S6–S8) and "1" is added to the number of inputs n to prepare for the next input of the false coin (S9).

Under this condition, input of a false coin is sensed in the coin passage 12 by means of the coin sensors 13*a* through 13*c* to detect voltage data of the false coin. Responsive to each of the voltage data, the CPU 24 produces a current one of the false-coin data and compares the current one with each of the maximum value and the minimum value. When the current one is greater than the maximum value, the CPU 24 overwrites the current one on the maximum data in the zeroth memorizing part 26. When the current one is smaller than the minimum value, the CPU 24 overwrites the current one on the minimum value in the zeroth memorizing part 26. In this event, the CPU 24 will be operable as each of a local judging arrangement and a local changing arrangement.

If the voltage data is larger than the maximum value and/or smaller than the minimum value, both values having been stored in the memory, both or either of the maximum and minimum values is overwritten respectively (S10–S13). Input of the false coin is repeated plural times for accurate definitions of the false-coin data, and this makes it possible to reflect the characteristics of the false-coin data securely in the maximum and minimum values. In other words, the CPU 24 determines a maximum datum and a minimum datum of the false-coin data. In this event, the CPU 24 will be referred to as a data determining arrangement.

Referring to FIG. 5A, the false-coin data are shown in a table. The false-coin data are represented by numerals taken by converting the voltage data in the manner known in the art. In other words, the CPU 24 converts the voltage data into the false-coin data. In this event, a combination of the CPU 24 and each of the coin sensors 13*a*, 13*b* and 13*c* will be operable as a local generating arrangement.

After completion of determination of the maximum and minimum values for the false-coin data (when the end switch 22 is turned on), the maximum and minimum values are corrected. In other wards, the CPU 24 corrects the maximum and the minimum data into a first and a second limiting datum by the use of correction values which will later be described. This correction control is carried out for perfect prevention of omission in the false-coin data. In this event, the CPU 24 will be referred to as a data correcting arrangement.

In accordance with the first and the second limiting data, the CPU 24 determines a range of the false coin kind. In this event, the CPU 24 will be operable as a range determining arrangement. A combination of the data determining, the data correcting, and the range determining arrangement will be referred to as a data processing arrangement for processing the false-coin data into processed data each determining the range of the false coin kind.

If the number of inputs is "0", the control procedure goes to a standby mode (S14). If the number of inputs n is so large that the maximum and minimum values obtained are proper enough for the false-coin data, the correction value will be small. If the number of inputs is small and reliability of the false-coin data is somewhat low, the correction values will be made larger. In other words, the CPU 24 determines each of the correction values to be inversely proportional to the number of the deposition.

Referring to FIG. 5B, relation between the number of input coin and the correction values is determined by a CPU 24 and shown in a table. Taking the coin sensor 13*a* as an example, the correction values are described in the following, when the number of inputs n is between 1 to 9, a range from the upper limit to the lower limit is made wider by adding a correction value (+3) to the maximum value and a correction value (−4) to the minimum value. This control is carried out such that the correction values become smaller as the number of inputs is increased to 10–19 (correction value (+2); correction value (−3)), and to 20–29 (correction value (+1); correction value (−2)). If the number of inputs reaches 30 or more, the maximum and minimum values are set as they are to the upper and lower limits (S15–S25). The same setting principle is applied to each of the coin sensor 13*b* and the coin sensor 13*c*. On determining the correction values, the CPU 24 is operable as a local determining arrangement determining the correction values in response to the counted signal. On carrying out the steps (S15–S25), the CPU 24 will be referred to as a range determining arrangement for determining a range of the false coin kind in accordance with the first and the second limiting data.

The upper and lower limits for false-coin data are thus determined by correcting the maximum value using a proper correction value, so that even if the number of inputs n is small, proper upper and lower limits can be set.

The upper and lower limits thus obtained are stored in upper-limit and lower limit memories of rejection specifying directory number "Gn", respectively (S26–S28). Then, it is determined whether the number Gn is the last group (S29). If not the last group, the next rejection specifying directory number Gn is set as Gn+1 and storage areas of the upper and lower limits obtained here are shifted. In the embodiment, upper and lower limits for subsequent false-coin data are thus stored successively. When successively storing the upper and lower limits for various kinds of false-coin data brings the number Gn into the last group, the next rejection specifying directory number Gn is set to "1" (S31). Therefore, false-coin data to be processed next is written over the oldest false-coin data.

As regards the steps S26–S31, the description will be made using other words. The second memorizing part 28 has the predetermined number of memory areas. The false-coin data are divided into a plurality of groups which are memorized in the memory areas, respectively. The CPU 24 judges whether or not the number of the groups is greater than the predetermined number. In this event, the CPU 24 is operable as a number judging arrangement. When the number of the groups is greater than the predetermined number, the CPU 24 writes a newest one of the groups over an oldest one of the groups in the second memorizing part 28. In this event, the CPU 24 is operable as writing arrangement.

The false-coin data is so controlled that the latest false-coin data (its registration should be given top priority) can be registered without fail. In other words, the CPU 24 stores, as the second coin data, the processed data in the second memorizing part 28. In this event, the CPU 24 will be referred to as a data storing arrangement.

Figure 6:
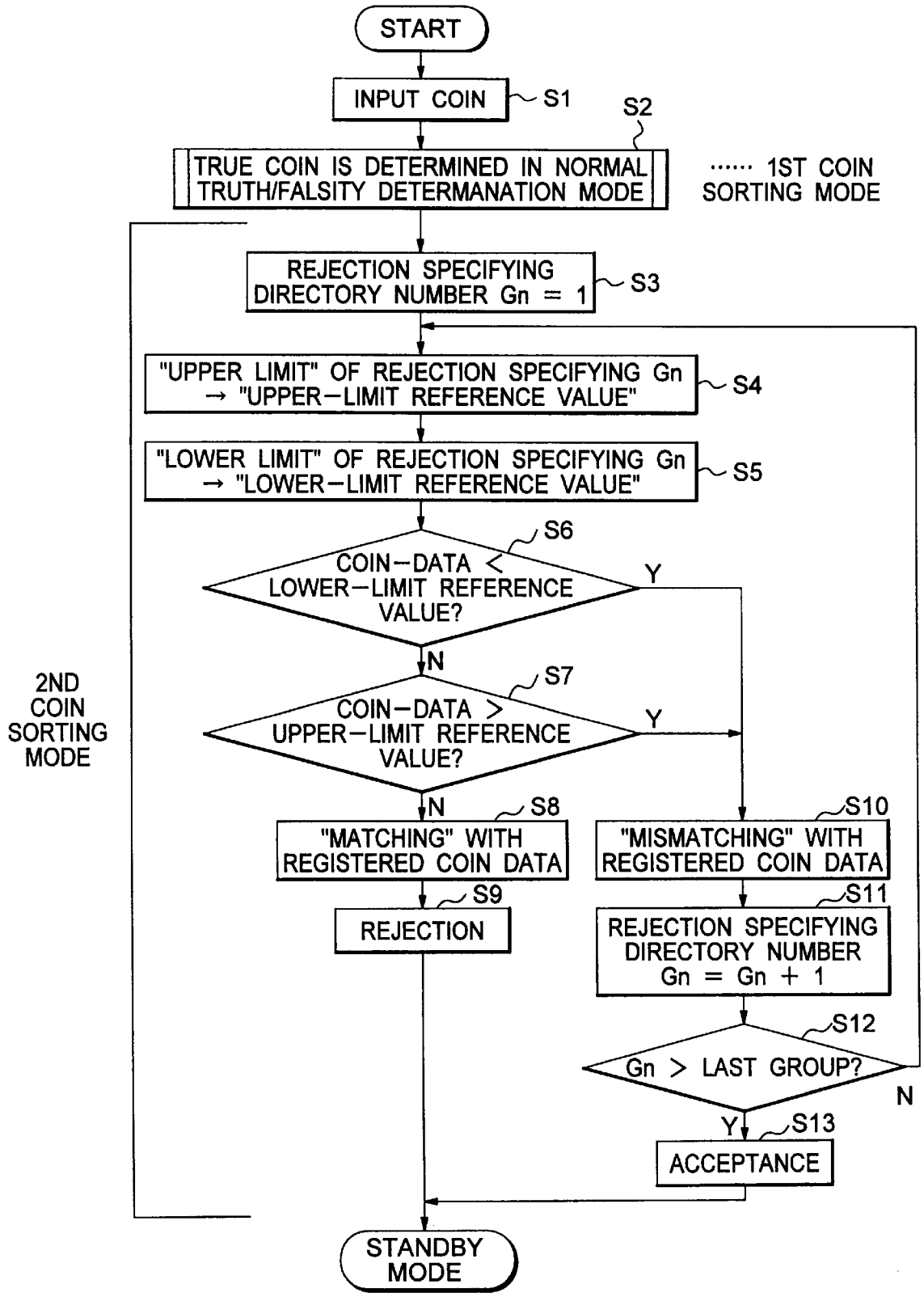
FIG. 6 is a flowchart for describing rejection control for false coins in the coin sorting device of FIGS. 1 and 2.

With reference to FIG. 6 in addition, the description will be made as regard control during coin processing in the coin sorting device 10 into which the above false-coin data have been registered.

As discussed, coin A, deposited from the coin slot 11, passes through the coin passage 12, and its voltage values are detected by means of the coin sensors 13*a* through 13*c*. Responsive to the voltage values, the CPU 24 generates third coin data. In this event, a combination of the CPU24 and each of the coin sensors 13*a*, 13*b* and 13*c* is operable as a data generating arrangement.

Thus, the genuineness of coin A is determined in the first or normal mode that discriminates between true and false coins (S1 and S2). On carrying out the first mode, the CPU 24 is referred to as a first judging arrangement which is responsive to the first and the third coin data and is for judging whether or not the deposited coin is included in the true coin kind.

If coin A is determined as a true coin, the control procedure goes to a second or particular mode. In the second mode, "1" is first selected for the rejection specifying directory number Gn, that is, the upper and lower limits of Gn=1 are set as "upper-limit reference value" and "lower-limit reference value" (S3–S5). The maximum and minimum voltage values of coin A are compared with the upper-limit reference value and lower-limit reference value, respectively. If data for coin A are within a range from the upper-limit reference value to the lower-limit reference value, coin A is regarded as matching with the registered false-coin data and hence as being rejected (S6–S9). As a result of this determination, the coin distributor 15 distributes coin A to the exhaust passage 17 to return the same from the return slot 18. If they are beyond the range, coin A is regarded as mismatching with the registered false-coin data. Then, the next rejection specifying directory number Gn+1 is read out, and the above steps S4 through S7 are repeated until the determination is made for the last group (S10–S12). If determined as not being a false coin after compared with all the registered false-coin data, coin A is accepted (S13). As a result of this determination, the coin distributor 15 distributes coin A to corresponding one of the coin tubes 16*a* through 16*d* according to the denomination. On carrying out the second mode, the CPU 24 is referred to as a second judging arrangement which is responsive to the second and the third coin data and is for judging whether or not the deposited coin is included in the false coin kind.

In the embodiment, since the coin sorting device 10 has the particular mode in addition to the normal mode, coins matching with the registered false-con data are individually eliminated in the second coin sorting mode.

Figure 7:
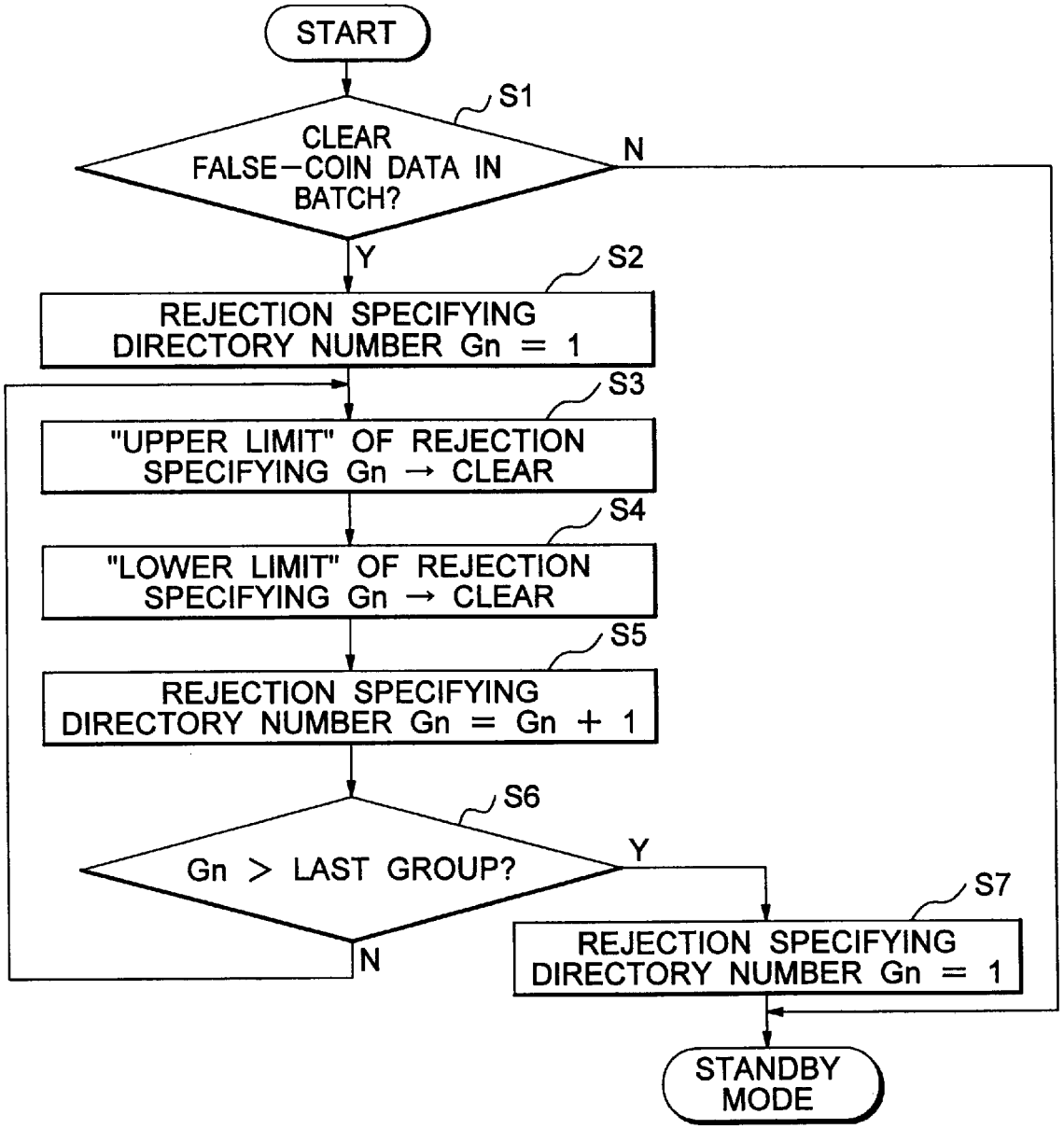
FIG. 7 is a flowchart for describing batched erase control for the false-coin data in the coin sorting device of FIGS. 1 and 2.

The coin sorting device 10 also carries out batched clear control shown in FIG. 7 so that it can recover from errors in registering false-coin data. Upon turning on the clear switch 23, "1" is first selected for the rejection specifying directory number Gn, that is, the upper and lower limits of Gn=1 are cleared (S1–S4). The same control operations are repeated up to the last group, so that the upper and lower limits of all the rejection specifying directory numbers Gn are erased (S5 and S6). In other words, the CPU 24 erase all the false-coin data in a batch. In this event, the CPU 24 will be referred to as an erasing arrangement.

After completion of the erase processing, the rejection specifying directory number Gn is set to "1" and the control procedure goes to the standby mode (S7) to prepare for reentering false-coin data in the same way as shown in FIGS. 3 through 5.

While the present invention has thus far been described in connection with a single embodiment thereof, it will readily be possible for those skilled in the art to put this invention into practice in various other manners. For example, although a "voltage change" is used as a characteristic change of false-coin data in the embodiment, any other kind of factor such as a "frequency change" or "phase change" may be used.

What is claimed is:

1. A coin sorting device comprising:

first memorizing means for memorizing a first coin datum representative of a true-coin kind;

second memorizing means for memorizing a second coin datum representative of a false-coin kind;

data generating means for generating a third coin datum representative of a coin which is deposited as a deposited coin into said coin sorting device;

first judging means connected to said first memorizing and said data generating means and responsive to said first and said third coin data for judging whether or not said deposited coin is included in said true-coin kind; and second judging means connected to said second memorizing and said data generating means and responsive to said second and said third coin data for judging whether or not said deposited coin is included in said false-coin kind.

2. A coin sorting device as claimed in claim 1, further comprising:

local generating means for generating false-coin data in response to deposition of predetermined false coins as said deposited coin into said coin sorting device;

data processing means connected to said local generating means for processing said false-coin data into a processed datum determining a range of said false-coin kind; and data storing means connected to said data processing and said second memorizing means for storing, as said second coin datum, said processed datum in said second memorizing means.

3. A coin sorting device as claimed in claim 2, wherein said data processing means comprises:

data determining means connected to said local generating means for determining a maximum datum and a minimum datum of said false-coin data;

data correcting means connected to said data determining means for correcting said maximum and said minimum data into a first and a second limiting datum by the use of correction values; and range determining means connected to said data correcting means for determining said range of the false-coin kind in accordance with said first and said second limiting data.

4. A coin sorting device as claimed in claim 3, wherein said local generating means generates a current one of said false-coin data whenever one of said predetermined false coins is deposited, said data processing means further comprising:

local judging means connected to said data determining and said local generating means for judging whether or not said current one is greater than said maximum datum; and data changing means connected to said local judging means for changing said maximum datum into said current one when said current one is greater than said maximum datum.

5. A coin sorting device as claimed in claim 3, wherein said local generating means generates a current one of said false-coin data whenever one of said predetermined false coins is deposited, said data processing means further comprising:

local judging means connected to said data determining and said local generating means for judging whether or not said current one is smaller than said minimum datum; and data changing means connected to said local judging means for changing said minimum datum into said current one when said current one is smaller than said maximum datum.

6. A coin sorting device as claimed in claim 3, wherein said data processing means further comprises:

a counter for counting up in response to said deposition of each of the predetermined false coins to produce a counted signal representative of the number of the deposition; and local determining means connected to said counter and said data correcting means for determining said correction values in response to said counted signal to supply said correction values to said data correcting means.

7. A coin sorting device as claimed in claim 6, wherein said data correcting means determines each of said correction values to be inversely proportional to said number of the deposition.

8. A coin sorting device as claimed in claim 2, wherein said second memorizing means has the predetermined number of memory areas, said false-coin data being divided into a plurality of groups which are memorized in said memory areas, respectively, said data storing means comprising:

number judging means for judging whether or not the number of said groups is greater than said predetermined number; and writing means connected to said number judging means and said second memorizing means for writing a newest one of said groups over an oldest one of said groups in said second memorizing means when said number of the groups is greater than said predetermined number.

9. A coin sorting device as claimed in claim 1, further comprising erasing means connected to said second memorizing means for erasing all said false-coin data in a batch.

* * * * *